US006439864B1

(12) United States Patent
Shaffer

(10) Patent No.: US 6,439,864 B1
(45) Date of Patent: Aug. 27, 2002

(54) TWO STAGE SCROLL VACUUM PUMP WITH IMPROVED PRESSURE RATIO AND PERFORMANCE

(75) Inventor: Robert W. Shaffer, Hamilton, OH (US)

(73) Assignee: Air Squared, Inc., Hamilton, OH (US)

( * ) Notice: Subject to any disclaimer, the term of this patent is extended or adjusted under 35 U.S.C. 154(b) by 0 days.

(21) Appl. No.: 09/715,726

(22) Filed: Nov. 20, 2000

Related U.S. Application Data

(63) Continuation-in-part of application No. 09/228,485, filed on Jan. 11, 1999, now Pat. No. 6,050,792.

(51) Int. Cl.[7] ..... F04C 18/04; F04C 25/02

(52) U.S. Cl. ..... 418/5; 418/55.2; 418/55.4; 418/60

(58) Field of Search ..... 418/5, 55.2, 55.4, 418/60

(56) References Cited

U.S. PATENT DOCUMENTS

| | | | | | |
|---|---|---|---|---|---|
| 801,182 | A | * | 10/1905 | Creux | 418/55.2 |
| 4,065,279 | A | | 12/1977 | McCullough | 418/55.4 |
| 4,382,754 | A | | 5/1983 | Shaffer et al. | 418/55.2 |
| 4,411,605 | A | * | 10/1983 | Sauls | 418/55.4 |
| 4,457,674 | A | | 7/1984 | Kawano et al. | 418/5 |
| 4,472,120 | A | | 9/1984 | McCullough | 418/55.1 |
| 4,477,238 | A | | 10/1984 | Terauchi | 418/5 |
| 4,673,339 | A | | 6/1987 | Hayano et al. | 418/55.1 |
| 4,726,100 | A | | 2/1988 | Etemad et al. | |
| 4,730,375 | A | | 3/1988 | Nakamura et al. | 418/55.4 |
| 4,732,550 | A | | 3/1988 | Suzuki et al. | 418/55.4 |
| 5,051,079 | A | | 9/1991 | Richardson, Jr. | 418/55.2 |
| 5,082,430 | A | | 1/1992 | Guttinger | 418/55.2 |
| 5,127,809 | A | | 7/1992 | Amata et al. | 418/55.2 |
| 5,222,882 | A | * | 6/1993 | McCullough | 418/55.2 |
| 5,232,355 | A | | 8/1993 | Fujii et al. | 418/55.2 |
| 5,258,046 | A | | 11/1993 | Haga et al. | 418/55.2 |
| 5,466,134 | A | | 11/1995 | Shaffer et al. | 418/55.2 |
| 5,496,161 | A | * | 3/1996 | Machida et al. | 418/55.2 |
| 5,632,612 | A | | 5/1997 | Shaffer | 418/55.4 |
| 5,752,816 | A | | 5/1998 | Shaffer | 418/55.2 |
| 5,759,020 | A | | 6/1998 | Shaffer | 418/55.4 |
| 6,050,792 | A | | 4/2000 | Shaffer | 418/5 |
| 6,068,459 | A | * | 5/2000 | Clarke et al. | 418/55.4 |
| 6,129,530 | A | | 10/2000 | Shaffer | 418/55.2 |
| 6,193,487 | B1 | * | 2/2001 | Ni | 418/55.2 |

FOREIGN PATENT DOCUMENTS

| | | | | |
|---|---|---|---|---|
| EP | 05138247 | | 5/1992 | 418/55.1 |
| GB | 2002455 | | 8/1977 | 418/55.2 |
| JP | 405157076 A | * | 6/1993 | 418/55.2 |
| JP | 7109981 | | 4/1995 | |

* cited by examiner

*Primary Examiner*—Thomas Denion
*Assistant Examiner*—Thai-Ba Trieu
(74) *Attorney, Agent, or Firm*—Paul M. Denk

(57) ABSTRACT

A scroll vacuum pump includes a first stage having a first stage fixed plate with a spiral involute, a second stage having a second stage fixed plate with a spiral involute wrap, and an orbiting plate having upper and lower surfaces. An involute spiral extends from the orbiting plate bottom surface to define a first stage orbiting plate and a second involute spiral extends from the orbiting plate top surface to define a second stage orbiting plate. The first stage involute wraps are taller than the second stage involute wraps. Gas is expanded in the first stage and compressed in the second stage. The first stage has an expansion ratio greater than or equal to one and the second stage has a compression ratio greater than or equal to one. However, that the pressure at the second stage exit is less than the pressure at the first stage inlet. To increase the efficiency of the pump, the tip seals of the involute spirals are extended as close as possible to the center of the involute to delay porting of gas by 180° of rotation.

14 Claims, 4 Drawing Sheets

TWO STAGE SCROLL VACUUM PUMP WITH IMPROVED PRESSURE RATIO AND PERFORMANCE

CROSS-REFERENCE TO RELATED APPLICATIONS

This application is a continuation-in-part upon application Ser. No. 09/228,485 filed on Jan. 11, 1999, now U.S. Pat. No. 6,050,792.

STATEMENT REGARDING FEDERALLY SPONSORED RESEARCH OR DEVELOPMENT

Not Applicable.

BACKGROUND OF THE INVENTION

This invention relates to scroll compressors, and in particular to a two-stage vacuum pump having an improved pressure ratio and performance.

Scroll devices have been used as compressors and vacuum pumps for many years. In general, they have been limited to a single stage due to the complexity of two or more stages.

Oil free scroll compressors have many leakage points. Typically, the scrolls operate with a small running clearance between the scrolls. This is a leakage point and reduces performance of the compressor. There are also leakage points under the tip seal and at the blow hole on either side of the tip seal.

BRIEF SUMMARY OF THE INVENTION

Briefly stated, a new and improved scroll vacuum pump includes a first stage including a first stage fixed plate having a spiral involute, a second stage including a second stage fixed plate having a spiral involute wrap, and an orbiting plate having upper and lower surfaces. An involute spiral extends from the orbiting plate bottom surface to define a first stage orbiting plate and a second involute spiral extends from the orbiting plate top surface to define a second stage orbiting plate. Preferably, the first stage involute wraps are taller than the second stage involute wraps.

The first and second stages each have inlets and outlets. The first stage inlet and second stage outlet are located at the approximate centers of the first and second stage fixed plates, respectively. The first stage outlet and second stage inlet are both at the periphery of the first and second stages, and are in fluid communication with each other so that gas will flow from the first stage to the second stage.

The fixed and orbiting involute wraps of the first and second stages mesh with each other to define chambers. The first stage chambers increase in size from the first stage inlet to the first stage outlet, and the second stage chambers decrease in size from the second stage inlet to the second stage outlet. Thus, the first stage expands the gas and the second stage compresses the gas. The first stage has an expansion ratio greater than or equal to one and the second stage has a compression ratio greater than or equal to one. The first stage expansion ratio can be the same as, or less than, than the second stage compression ratio.

The first and second stage fixed plates define a lower housing. An upper housing is mounted to the second stage fixed plate and has an end surface spaced from the second stage fixed plate defining an exit chamber into which the second stage exit ports. The upper housing includes an outlet from said exit chamber.

The scroll vacuum pump includes a motor mounted to an outer surface of the upper housing to drive the orbiting plate. The motor includes an output shaft which extends through the exit chamber and the second stage fixed plate. The orbiting plate is operatively connected to said output shaft to be driven thereby. The motor output shaft is at atmospheric pressure. Thus, no special sealing of the output shaft is required.

To increase the efficiency of the pump, the involute spirals are extended as close as possible to the center of the involute to delay porting of gas by 180° of rotation.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention.

Figure 1:
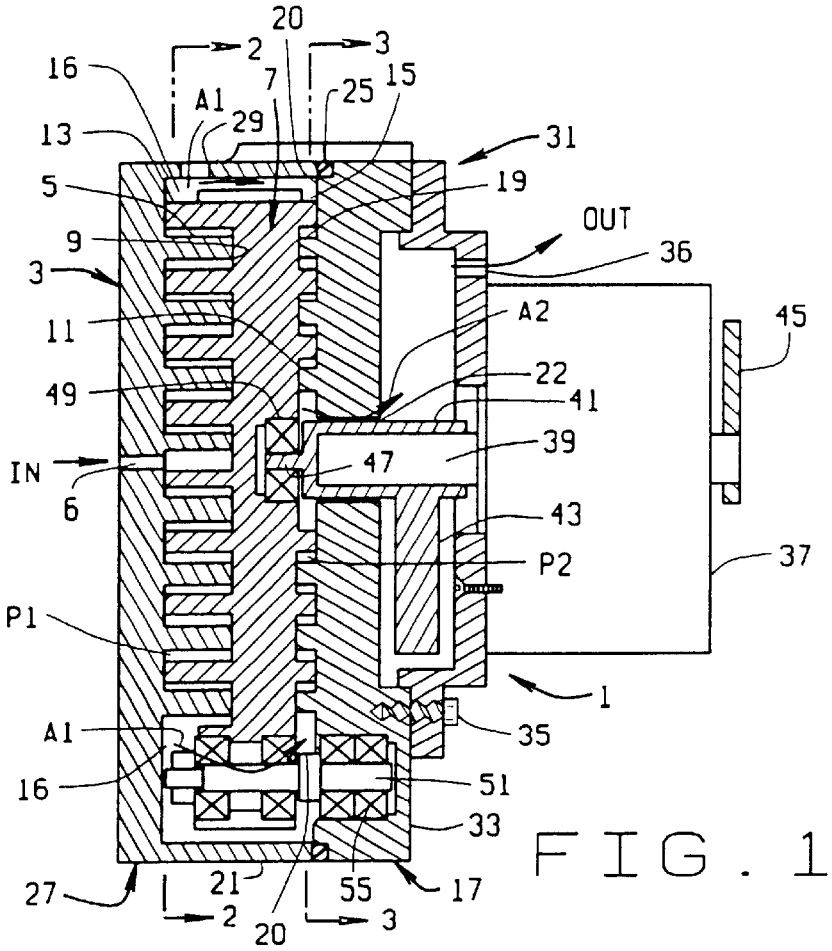
FIG. 1 is a sectional view of a two-stage scroll vacuum pump of the present invention.

A two stage scroll vacuum pump 1 of the present invention is shown generally in FIG. 1. The scroll vacuum pump 1 includes a first stage fixed scroll or plate 3 having an involute wrap 5. An inlet port 6 is located in the center of the fixed plate 3. An orbiting plate 7 has a lower surface 9 and an upper surface 11 with lower (or first stage) and upper (or second stage) involute wraps 13 and 15. The orbiting involute wrap 13 for the first stage extends down from the lower surface 9 and the orbiting involute wrap 15 extends up from the upper surface 11.

Figure 2:
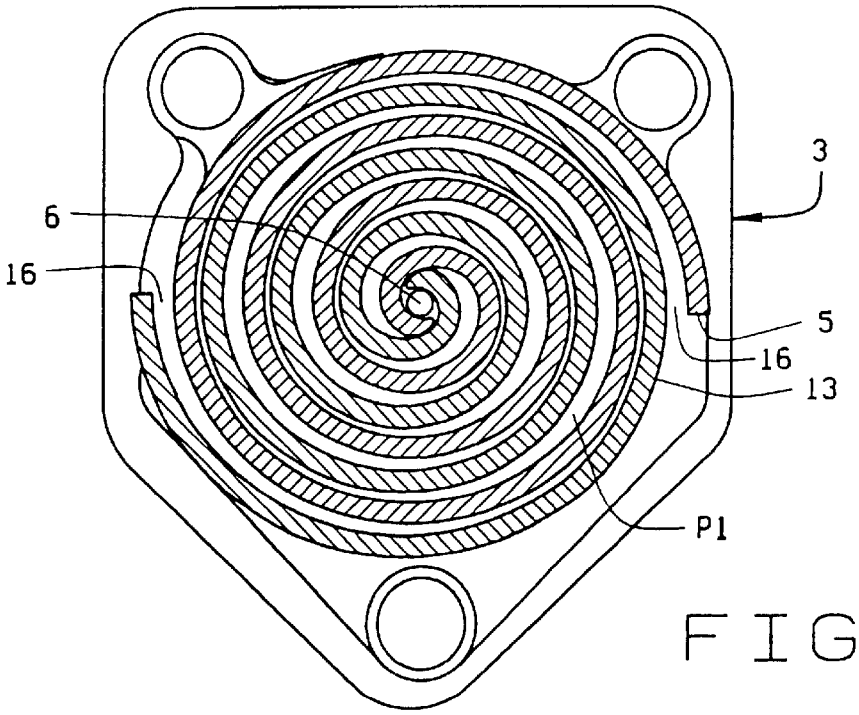
FIG. 2 is a cross-sectional view of the first stage of the scroll vacuum pump taken along line 2—2 of FIG. 1.

The first stage involute wraps 5 and 13 mesh as shown in FIG. 2 to define first stage pockets P1. As the orbiting wrap 13 moves relative to the fixed wrap 5, the pocket P1 expands in size from the inlet 6 to the first stage outlet 16 at the periphery of the first stage.

Figure 3:
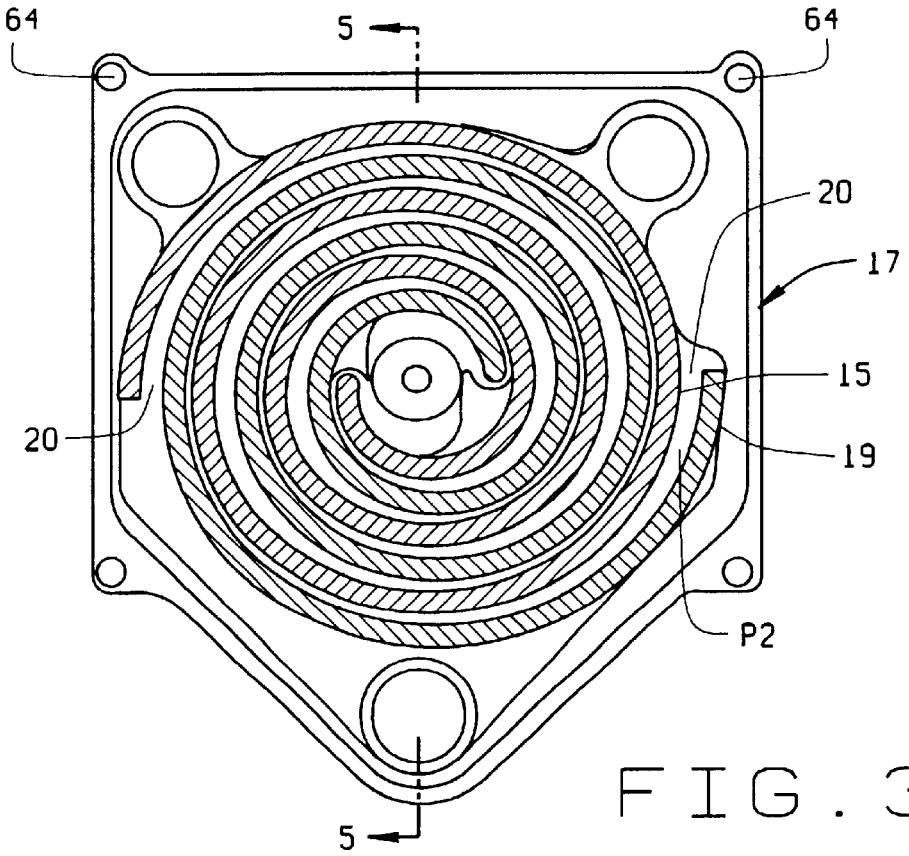
FIG. 3 is a cross-sectional view of the second stage of the scroll vacuum pump taken along line 3—3 of FIG. 1.

A second stage fixed scroll or plate 17 is positioned above the orbiting plate 7, and includes a second stage fixed involute wrap 19 which meshes with the orbiting involute 15, as seen in FIG. 3. The second stage wraps 15 and 19 define pockets P2 which decrease in size from the entrance 20 at the periphery to the second stage to the exit 22 at the center of the second stage. As best seen in FIG. 1, the first stage wraps 5 and 13 are larger (i.e., taller) than the second stage wraps 15 and 19.

The fixed scroll plate 3 includes a side wall 21 which extends up from the base of the fixed scroll plate. The second stage fixed plate 17 rests on the first stage fixed plate wall 21 and is aligned with the wall 21 in a conventional manner, for example, with dowel pins 23.(not shown) Fastening means, such as screws, bolts, etc. are provided, as at 64, to secure the scrolls in place. An O-ring 25 is seated in a groove in the second stage fixed plate 17 to form a gas tight seal between the first and second stages. As seen in FIG. 1, the first and second stage fixed plate form a lower housing 27 for the vacuum pump 1. An interstage pressure or vacuum outlet 29 can be formed in the wall 21 at the outlet 16 from the first stage.

An upper housing 31 is fixed to the outer surface 33 of the second stage fixed plate 17 using a suitable fastener 35, such as a screw, bolt, or the like. An outlet port 36 is formed in the top of the housing 31 and defines an outlet for the vacuum pump 1. A motor 37 is mounted to the housing 31 to drive the orbiting plate 7. The motor 37 has an output shaft 39. A crankshaft 41 having an eccentric weight 43 is journaled about the output shaft. A counterweight 45 is mounted to the top of the motor 35 at the opposite end of the output shaft 39. The crankshaft extends through the second stage fixed scroll. A bottom pin 47 extends from the bottom of the crank shaft. The pin 47 is eccentric to the orbiting plate 7 and has a bearing 49 journaled thereabout. The bearing 49, in turn, is received in a recess in the orbiting plate 7 in the center of the orbiting plate. The orbiting scroll is supported by idler shafts 51 and supporting bearings 55 as disclosed in U.S. Pat. No. 5,466,134, which is incorporated herein by reference.

As can be seen by the arrows A1 and A2, the air is pulled in at the center of the first stage at the inlet 6, and is moved to the first stage outlet 16 at periphery of the first stage, causing the air to expand. The expanded air follows the arrow A1 to move from the periphery of the first stage to the entrance 20 to the second stage at the periphery of the second stage. In the second stage, the air is moved to the center of the fixed scroll to compress the air. The air exits the second stage at the second stage exit 22 and, following the arrow A2, enters the upper housing 31 along the crank shaft 41. The air then exits the upper housing 31 at the vacuum pump outlet 36, which is at atmospheric pressure. Because the drive shaft is at atmospheric pressure, no special sealing of the drive shaft is required.

The first stage expansion ratio can be any amount greater than or equal to one. The displacement of the first stage, however, is greater than the second stage so that the interstage pressure will be at some value between the first stage inlet and the second stage discharge. The second stage compression ratio is greater than or equal to one.

Figure 4:
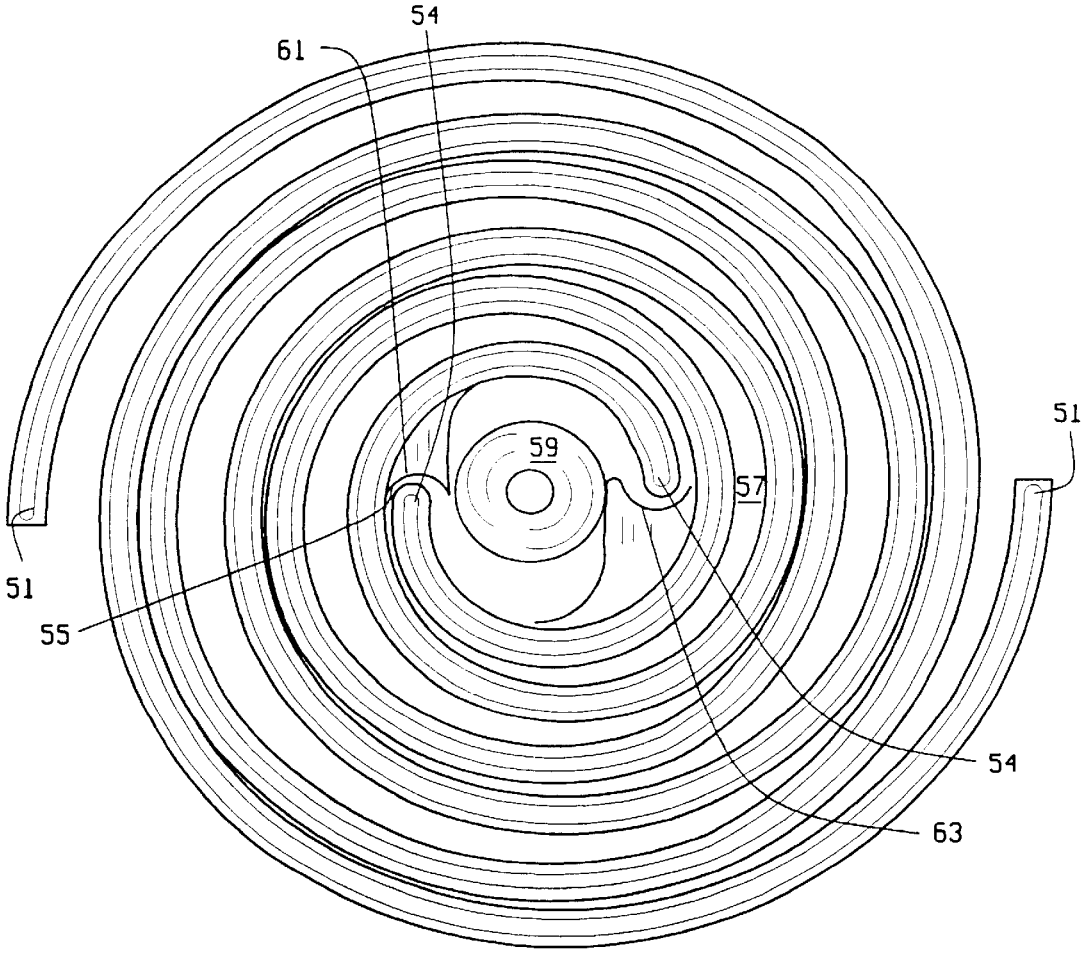
FIG. 4 is a plan view of the second stage showing an improved porting means at the center of the scroll.

FIG. 4 shows an improved porting means at the center of the second stage fixed scroll. The scroll includes involute spirals 51 having tip seals 54. The tip seal 54 is extended as close as possible to the center of the involute 51. Normally, as one scroll orbits clockwise about the other, the scrolls will port in the position shown, with the contact formed at 55. As the scroll moves clockwise, the gap at 55 will open, causing exposure of the gas trapped in the gaps 57 between the spirals 51 to the gas in the discharge area 59. However, by properly sizing the radius at the end of the scroll involute 61, and the porting radius 63, the porting can be delayed by 180° of rotation. This greatly increases the compression (or expansion) ratio, thus improving performance.

Figure 5:
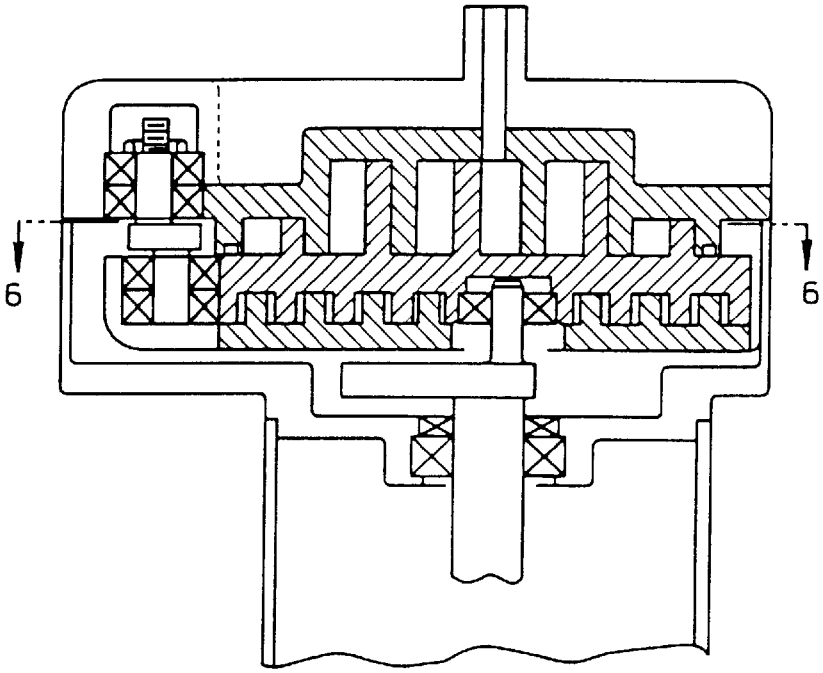
FIG. 5 is a cross-sectional view of an alternative embodiment of the two-stage scroll vacuum pump.
Figure 6:
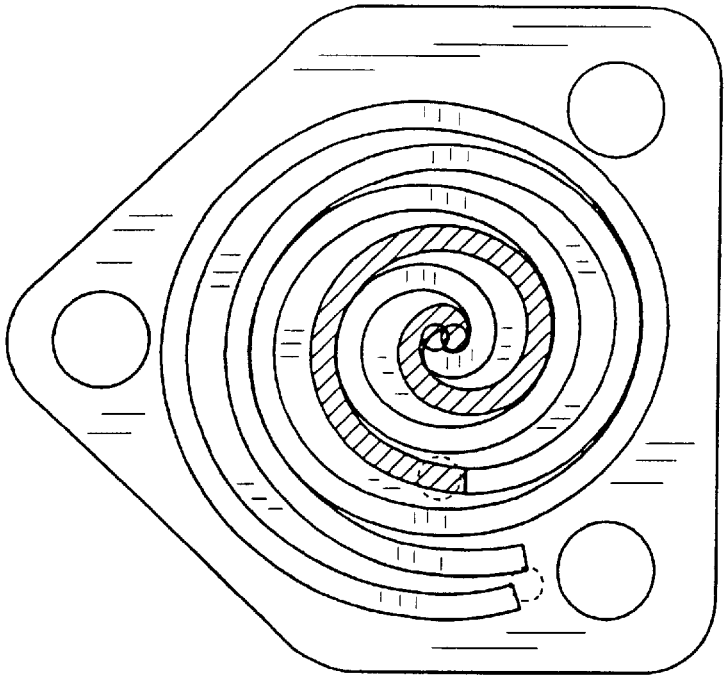
FIG. 6 is a cross-sectional view taken along line 6—6 of FIG. 5.

An alternative configuration of the first stage is shown in FIGS. 5 and 6. In this configuration, a single fixed plate and a single orbiting plate is provided. The size of the involutes of the plates change, as can be seen in the figures. By stepping the involute height, as shown in the figures, one or more times, compression can take place in the first stage in a step manner with flow from the center to the periphery. The expansion (or compression) ratio in each stepped region will be one or larger. This configuration of the first stage is described in my co-pending application Ser. No. 09/228,485, filed in the United States Patent Office on Jan. 11, 1999, now U.S. Pat. No. 6,050,792, which is incorporated herein by reference. This configuration has the added advantage of providing compression in the first stage, instead of expansion, making the first stage more efficient.

In view of the above, it will be seen that the advantages of the present invention have been achieved and other advantageous results have been obtained. As various changes could be made in the above constructions without departing from the scope of the invention, it is intended that all matter contained in the above description or shown in the accompanying drawings shall be interpreted as illustrative and not in a limiting sense. Although only two stages are shown, more stages could be employed. Thus, the scroll compressor could have three, four or more stages. There could be a mid-port for each stage, to allow for various stages to be by-passed, connected in series, or open to the atmosphere, as may be desired for a particular function.

What is claimed is:

1. A scroll vacuum pump having:

a first stage including a first stage fixed plate having a spiral involute, a first stage orbiting plate having a spiral involute wrap, a first stage inlet, and a first stage outlet; said spiral involute wraps meshing with each other to define chambers, said chambers increasing in size from said first stage inlet to said first stage outlet; and a second stage including a second stage fixed plate having a spiral involute wrap, a second stage orbiting plate having a spiral involute, a second stage inlet in fluid communication with said first stage outlet, and a second stage outlet; said second stage spiral involute wraps meshing with each other to define chambers, said chambers decreasing in size from said second stage inlet to said second stage outlet;

said first stage having an expansion ratio greater than or equal to one and said second stage having a compression ratio greater than or equal to one; and the displacement of the first stage is greater than the displacement of the second stage so that the interstage pressure will be at a value between the first stage inlet and the second stage outlet.

2. The scroll vacuum pump of claim 1 wherein the first stage involute wraps are taller than the second stage involute wraps.

3. The scroll vacuum pump of claim 1 wherein the first stage inlet is located at an approximate center of said first stage fixed plate; said first stage outlet is at a periphery of said first stage; said second stage inlet is at a periphery of said second stage; and said second stage outlet is located at an approximate center of said second stage fixed plate.

4. The scroll vacuum pump of claim 1 wherein including a single orbiting plate, said plate having an upper surface and a lower surface; said upper surface defining said second stage orbiting plate and said lower surface defining said first stage orbiting plate.

5. The scroll vacuum pump of claim 1 including an upper housing; said upper housing having an end surface spaced from said second stage fixed plate to define an exit chamber; said second stage exit being in fluid communication with said exit chamber; said upper housing including an outlet from said exit chamber.

6. The scroll vacuum pump of claim 1 including a motor which drives said orbiting involute wraps; said motor being including an output shaft which extends through said second stage fixed plate; said first and second stage orbiting scroll plates being operatively connected to said output shaft to be driven thereby; said second stage outlet surrounding said output shaft, such that said output shaft is at atmospheric pressure.

7. The scroll vacuum pump of claim 1 wherein the fixed and orbiting involutes of the first stage have a central portion and an peripheral portion; the central portion and peripheral portions having different heights.

8. The scroll vacuum pump of claim 7 wherein the central portion of the fixed and orbiting involutes is taller than the peripheral portion of the fixed and orbiting involutes.

9. The scroll vacuum pump of claim 1 wherein the pressure at the second stage exit is less than the pressure at the first stage inlet.

10. A scroll vacuum pump having:

a first stage including a first stage fixed plate having a spiral involute, a first stage orbiting plate having a spiral involute wrap, a first stage inlet, and a first stage outlet; said spiral involute wraps meshing with each other to define chambers, said chambers increasing in size from said first stage inlet to said first stage outlet; said first stage having an expansion ratio greater than or equal to one;

a second stage including a second stage fixed plate having a spiral involute wrap, a second stage orbiting plate having a spiral involute, a second stage inlet in fluid communication with said first stage outlet, and a second stage outlet; said second stage spiral involute wraps meshing with each other to define chambers, said chambers decreasing in size from said second stage inlet to said second stage outlet; and said second stage having a compression ratio greater than or equal to one;

an upper housing; said upper housing having an end surface spaced from said second stage fixed plate to define an exit chamber; said second stage exit being in fluid communication with said exit chamber; said upper housing including an outlet from said exit chamber; and a motor which drives said orbiting involute wraps; said motor being mounted to an outer surface of said upper housing and including an output shaft which extend through said exit chamber and said second stage fixed plate; said first and second stage orbiting scroll plates being operatively connected to said output shaft to be driven thereby; said output shaft being at atmospheric pressure;

said scroll vacuum pump lacking any sealing which would seal said shaft from ambient atmosphere.

11. A scroll vacuum pump having:

a first stage including a first stage fixed plate having a spiral involute, a first stage orbiting plate having a spiral involute wrap, a first stage inlet, and a first stage outlet; said spiral involute wraps meshing with each other to define chambers, said chambers increasing in size from said first stage inlet to said first stage outlet; and a second stage including a second stage fixed plate having a spiral involute wrap, a second stage orbiting plate having a spiral involute, a second stage inlet in fluid communication with said first stage outlet, and a second stage outlet; said second stage spiral involute wraps meshing with each other to define chambers, said chambers decreasing in size from said second stage inlet to said second stage outlet;

said first stage having an expansion ratio greater than or equal to one and said second stage having a compression ratio greater than or equal to one;

the involute spirals being provided with tip seals; said tip seals being extended as close as possible to the center of the involute to delay porting of gas by 180° of rotation.

12. A scroll pump having:

a first stage including a first stage fixed plate having a spiral involute, a first stage orbiting plate having a spiral involute wrap, a first stage inlet, and a first stage outlet; said spiral involute wraps meshing with each other to define chambers, said chambers increasing in size from said first stage inlet to said first stage outlet; and a second stage including a second stage fixed plate having a spiral involute wrap, a second stage orbiting plate having a spiral involute, a second stage inlet in fluid communication with said first stage outlet, and a second stage outlet; said second stage spiral involute wraps meshing with each other to define chambers, said chambers decreasing in size from said first stage inlet to said first stage outlet;

said first stage involute wraps having a central portion and an peripheral portion; the central portion and peripheral portions having different heights; the central portion of the fixed and orbiting involutes wraps being taller than the peripheral portion of the fixed and orbiting involutes.

13. The scroll pump of claim 12 wherein said first stage has an expansion ratio greater than or equal to one and said second stage having a compression ratio greater than or equal to one.

14. The scroll pump of claim 12 wherein said first stage expansion ratio is less than or equal to said second stage compression ratio.

* * * * *